United States Patent [19]

Kanaya

[11] Patent Number: 4,815,725

[45] Date of Patent: Mar. 28, 1989

[54] PAPER FEED CONTROL DEVICE FOR COPIER

[75] Inventor: Koichi Kanaya, Tokyo, Japan

[73] Assignee: Ricoh Company, Ltd., Tokyo, Japan

[21] Appl. No.: 185,271

[22] Filed: Apr. 18, 1988

Related U.S. Application Data

[63] Continuation of Ser. No. 870,525, Jun. 4, 1986, abandoned.

[30] Foreign Application Priority Data

Jun. 4, 1985 [JP] Japan ..... 60-119754
Jun. 14, 1985 [JP] Japan ..... 60-128060

[51] Int. Cl.[4] ..... B65H 7/14; B65H 7/04
[52] U.S. Cl. ..... 271/258; 271/155
[58] Field of Search ..... 271/110, 111, 117, 126, 271/127, 147, 152, 153, 154, 155, 162, 258, 259, 265

[56] References Cited

U.S. PATENT DOCUMENTS 4,369,442 1/1983 Werth et al. ..... 194/217 X

FOREIGN PATENT DOCUMENTS 0113160 9/1979 Japan ..... 271/155
0149931 11/1981 Japan ..... 271/111
0063637 4/1983 Japan ..... 271/258
0119530 7/1983 Japan ..... 271/258
0183546 10/1983 Japan ..... 271/258
0086530 5/1984 Japan ..... 271/259
0040361 3/1985 Japan ..... 271/258

*Primary Examiner*—Joseph J. Rolla
*Assistant Examiner*—Edward S. Ammeen
*Attorney, Agent, or Firm*—Oblon, Fisher, Spivak, McClelland & Maier

[57] ABSTRACT

A paper feed control device for controlling a paper feed level, or height, to a predetermined one by moving up and down a tray which is loaded with a stack of papers by a motor or the like. A proportional relation between the number of papers fed as counted by a paper counter and the number of encoder pulses which is associated with an amount of movement of the tray is calculated to determine how many pulses will appear before a near-paper-end condition is reached. Based on a result of the decision, the paper feed is controlled.

1 Claim, 9 Drawing Sheets

Fig. 7

| Vcc | $\overline{E}$ | $\overline{G}$ | $\overline{W}$ | MODE | DO | POWER |
|---|---|---|---|---|---|---|
| ≤5.5 VOLTS | H | x | x | DESELECT | HIGH Z | STANDBY |
| | L | x | L | WRITE | $D_{IN}$ | ACTIVE |
| | L | L | H | READ | $D_{OUT}$ | ACTIVE |
| ≥4.75 VOLTS | L | H | H | READ | HIGH Z | ACTIVE |
| <4.5 VOLTS | x | x | x | WRITE PROTECT | HIGH | ZERO |

PAPER FEED CONTROL DEVICE FOR COPIER

This application is a continuation of application Ser. No. 870,525, filed on June 4, 1986, now abandoned.

BACKGROUND OF THE INVENTION

The present invention relates to a paper feed control device which is installed in a copier for controlling a paper feed level to a predetermined one by moving up and down a tray which is loaded with a stack of papers by means of a motor or the like.

In a high-speed copier, it sometimes happens that before a document is fed by an RDF (recirculation document feeder) or an ADF (automatic document feeder) to a predetermined copying station, several papers have been fed from a paper feeding device. Paper end, therefore, needs to be detected before the tray is emptied, i.e., while several papers are still left in the tray.

It has been customary to estimate a remaining amount of papers based on a level, or height, of the tray. Specifically, when the tray has been raised beyond a certain reference level, it is determined that a paper-end or near-paper-end condition is reached in order to avoid an occurrence that papers are used up during the course of copying cycles. Usually, a level of the tray is determined by counting up pulses which an encoder mounted in the paper feeding device generates during upward and downward movements of the tray. Meanwhile, various kinds of papers are used with a copier and they differ in thickness, for example. It follows that for the same number encoder output pulses a comparatively large number of papers may have been left if the paper thickness is small and a comparatively small number of papers is otherwise. In this manner, the prior art system for sensing a remaining amount of papers lacks in reliability.

SUMMARY OF THE INVENTION

It is therefore an object of the present invention to provide a paper feed control device for a copier which is capable of accurately sensing a remaining amount of papers before a copying operation with no regard to the kind of papers used.

It is another object of the present invention to provide a paper feed control device for a copier which is capable of reducing the frequency of paper supply as far as possible by accurately sensing near-paper-end with no regard to the kind of papers used.

It is another object of the present invention to provide a generally improved paper feed control device for a copier.

In one aspect of the present invention, there is provided a paper feed control device for controlling a paper feed level, or height, to a predetermined one by moving up and down a tray which is loaded with a stack of papers by a motor or the like. The device comprises an encoder for generating pulses responsive to an amount of movement of the tray during each of upward and downward movements of the tray, a counter for counting papers which are sequentially fed from the tray, a decision circuit for calculating a relation between a number of papers fed from the tray and pulses generated by the encoder and determining a number of pulses which are to appear before near-paper-end, a first store for storing the number of papers fed, the number of pulses generated by the encoder and other data, and a second store storing a program for interrupting paper feed based on an output of the decision circuit.

In another aspect of the present invention, there is provided a paper feed control device for controlling a paper feed level, or height, to a predetermined level by moving up and down a tray which is loaded with a stack of papers by a motor or the like. The device comprises an encoder for generating pulses responsive to a particular amount of movement of the tray during each of upward and downward movement of the tray, a paper counter for counting papers which are sequentially fed from the tray, a pulse counter for determining how many pulses have been generated for the feed of a predetermined number of papers, a calculating circuit for calculating how many papers are necessary to complete a particular copy mode which is selected by an operator, a first store for storing the number of papers fed, the number of pulses and other data, and a second store storing a program for controlling the above-stated means.

The above and other objects, features and advantages of the present invention will become more apparent from the following detailed description taken with the accompanying drawings.

BRIEF DESCRIPTION OF THE DRAWINGS

FIG. 7 shows a truth table associated with the memory;

DESCRIPTION OF THE PREFERRED EMBODIMENTS

While the paper feed control device for a copier of the present invention is susceptible of numerous physical embodiments, depending upon the environment and requirements of use, substantial numbers of the herein shown and described embodiments have been made, tested and used, and all have performed in an eminently satisfactory manner.

Figure 1:
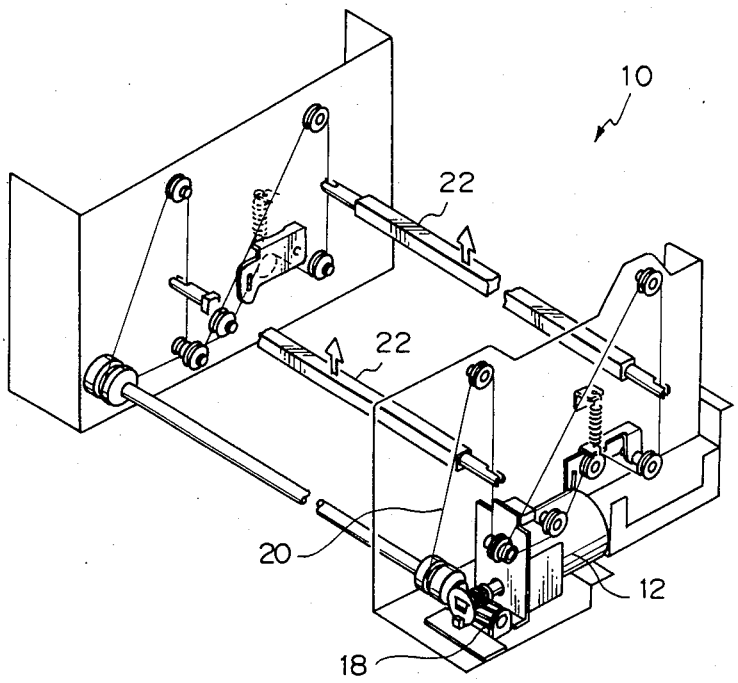
FIG. 1 is a perspective view of a drive mechanism included in a paper feeding apparatus to which the present invention is applicable.
Figure 2:
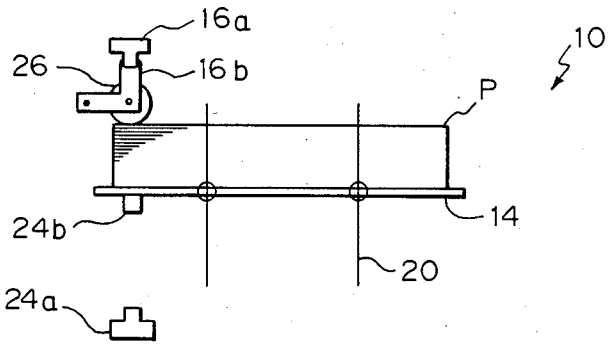
FIG. 2 is a schematic diagram showing a positional relationship between sensors arranged around a tray and a paper feed position associated with the apparatus of FIG. 1.

Referring to FIG. 1 of the drawings, a drive mechanism associated with a paper feeding apparatus to which the present invention is applied is shown. Sensors arranged around a tray and a paper feed level are schematically shown in FIG. 2. The paper feeding apparatus, generally 10, includes a motor 12 adapted to move up and down a tray 14 which is loaded with a stack of papers P. The motor 12 is controlled by a signal which is outputted by a central processing unit (CPU), which will be described. Because papers cannot be fed unless the tray 14 is constantly and fully raised during the course of paper feed, the apparatus 10 is programmed such that every time a screening plate **16*b* has moved away from a photointerrupter 16*a*, a raise signal is fed to the motor 12. The rotation of the motor 12 is transmitted by a worm gear 18 and a wire 20 to a pair of tray shafts 22. The tray 14 is fixedly mounted on the tray shafts 22. An output signal of the photointerrupter 16*a* which cooperates with the plate 16*b* to sense the rise of the tray 14 to a predetermined paper feed level, or upper limit, is routed to the CPU. A photointerrupter 24*a* and a screening plate 24*b*, on the other hand, cooperate to sense the fall of the tray 14 to a predetermined lowermost level, or lower limit. When an output of the photointerrupter, or lower limit sensor, 24*a* has been fed to the CPU, the rotation of the motor 12 is stopped. Rolls 26 are mounted on the plate 16*b*** and, although not shown in the drawing, driven from another drive source to feed out papers one by one.

Figure 3:
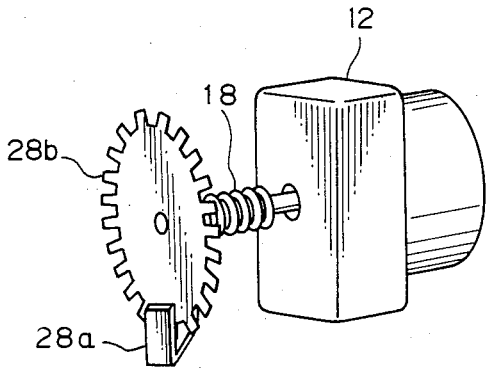
FIG. 3 is a view of an encoder.

Referring to FIG. 3, there is shown how encoder pulses are generated during upward and downward movements of the tray 14 which is driven by the motor 12. Upon rotation of the motor 12, a photointerrupter **28*a* and a screening plate 28*b*** which constitute an encoder generater pulses with no regard to the direction of rotation and applies the pulses to the CPU.

Figure 4:
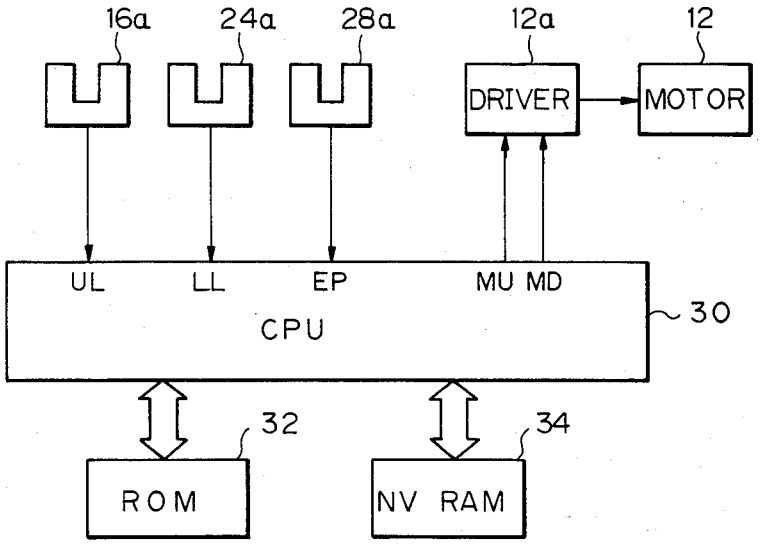
FIG. 4 is a block diagram representative of a paper feed control in accordance with the present invention.

Referring to FIG. 4, a circuit associated with the control of the apparatus 10 is shown in a block diagram. The CPU 30 activates a motor driver **12*a* responsive to sensor signals which are applied to ports UL, LL and EP thereof and thereby controls the motor 12, performs various mathematical operations, and effects controls according to a predetermined program. A read only memory (ROM) 32 stores programs for controlling the apparatus 10. A non-volatile random access memory (NV-RAM) 34 is allowed to hold data memorized therein even when a power source is turned off by a backup battery which is built therein. As the photointerrupters 16*a*, 24*a* and 28*a* sense their associated screening plates, the ports UL, LL and EP assigned to them, respectively, become logical high level, or a ONE. When a control port MU associated with the motor 12 has been turned to a ONE, the motor 12 is rotated in a direction for raising the tray 14. Conversely, when a control port MD has been turned to a ONE, the motor 12 is rotated in a direction for lowering the tray 12. In this particular arrangement, the NV-RAM 34** is implemented with MK48ZO2 available from MOSTEK. This memory is constructed by loading an ordinary RAM with a lithium battery and in such a manner as to automatically activate a backup battery when sensed cut-off of a main power source.

Figure 5:
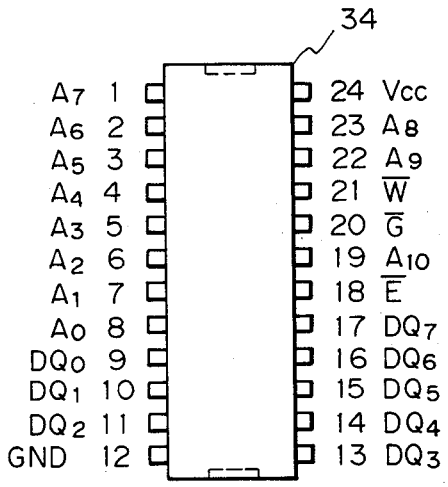
FIG. 5 shows pin positions of a non-volatile random access memory.
Figure 6:
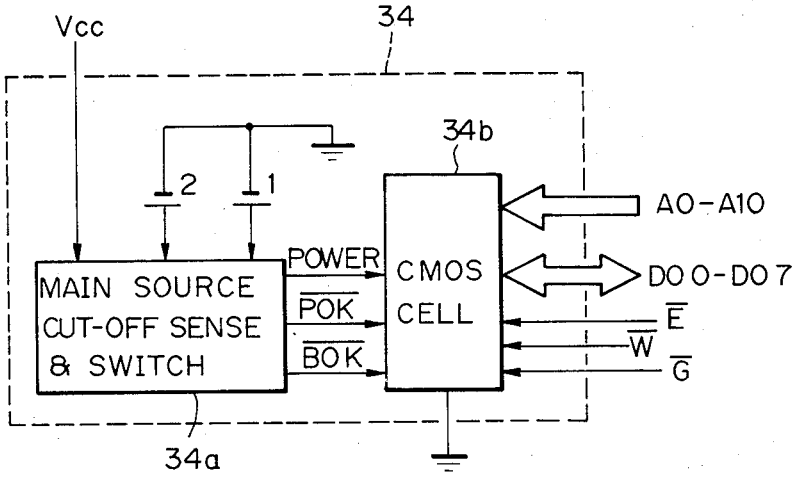
FIG. 6 is a block diagram of the memory.

FIG. 5 shows an arrangement of pins of the NV-RAM 34, FIG. 6 the NV-RAM 34 in a block diagram, and FIG. 7 a truth table. As shown in FIG. 5, the NV-RAM 34 includes pins $A_0$ to $A_{10}$ for address input, a pin E for write enable, a pin G for output enable, and pins $DO_0$ to $DO_7$ for data in/data out.

As shown in FIG. 5, the NV-RAM 34 operates in exactly the same way as an ordinary RAM so long as a main power source is turned on. However, the NV-RAM 34 is equipped with a voltage detection circuit so as to change the behavior depending upon a voltage $V_{cc}$. While the voltage $V_{cc}$ lies within a range of 4.7 volts to 5.50 volts, the NV-RAM 34 allows data to be written thereinto and read thereoutof by operating the pins E, G and W. As the voltage $V_{cc}$ is lowered to a range of 4.50 volts to 4.75 volts, the NV-RAM 34 assumes a write inhibit mode. Further, when the voltage $V_{cc}$ has been lowered to a range of 3.00 volts to 4.50 volts, the data input pins gain a don't-care state while the output pins gain a high impedance. As soon as the voltage $V_{cc}$ is lowered beyond 3.00 volts, the power supply is automatically switched from the main power source to the built-in lithium battery so as to prevent data stored from being lost. At a power buildup stage, a process which is opposite to the above-described is performed. In FIG. 6, the reference numeral **34*a* designates a main source cut-off sensing and switching circuit, and 34*b*** a CMOS cell.

A basic operation of the apparatus 10 is as follows.

As the power source is turned on, the tray 14 is once lowered to the lower limit. As the lower limit sensor senses the screening plate **24*b*, the motor 12 is deenergized. At this instant, a counter adapted to count encoder pulses is reset to zero. If papers are present in the tray 14, a raise signal is fed from the CPU 30 to the motor driver 12*a* to thereby raise the tray 14. The encoder pulses are counted and applied to a pulse counter. When the plate 16*b* has been forced into the upper limit sensor, the motor 12 is deenergized. The stack of papers on the tray 14 is sequentially reduced after the start of paper feed. When the plate 16*b* has been moved clear of the upper limit sensor, the motor 12 is rotated again in a direction for raising the tray 14; as soon as the plate 16*b* enters the upper limit sensor 16*a* again, the motor 12 is stoped. Such a procedure allows the papers to be constantly held at a predetermined level. At this instant, too, encoder pulses are counted every time the motor 12** is rotated, the pulse counter being sequentially incremented.

So far as an ordinary low-speed copier is concerned, interrupting a copying operation after all the papers have been used up is no problem from a timing standpoint. However when it comes to a high-speed copier, such is undesirable because at the time when one intends to interrupt the operation several documents have already been fed into RDF and latent images and/or developed images have been formed on a photoconductive element. To avoid such an occurrence, in a high-speed copier, a condition wherein the papers have run short is regarded as a near-paper-end condition to interrupt the copying operation. That is, whether the pulse counter which is counting encoder pulses is incremented beyond a certain reference value is checked. Specifically, assume that 1,000 encoder pulses are generated during movement of the tray 14 which is empty from the lower limit to the upper limit. Then, when the pulse counter has been incremented to "950" to "990" during paper feed, it may be determined that the papers have run short. However, even if the pulse counter is incremented to "990", the number of remaining papers obviously depends on the thickness of the papers used. For example, in the case of relatively thin papers such as second originals, fifty of them will correspond to only several ones of relatively thick papers.

In light of the above, in accordance with a first embodiment of the present invention, the number of papers actually fed and the number of encoder pulses generated then are held in mutual correspondence in order to estimate, for a particular kind of papers which are currently stacked on the tray, how many pulses will represent a paper-end condition. Such a control will be described with reference to flowcharts hereinafter.

Figure 8:
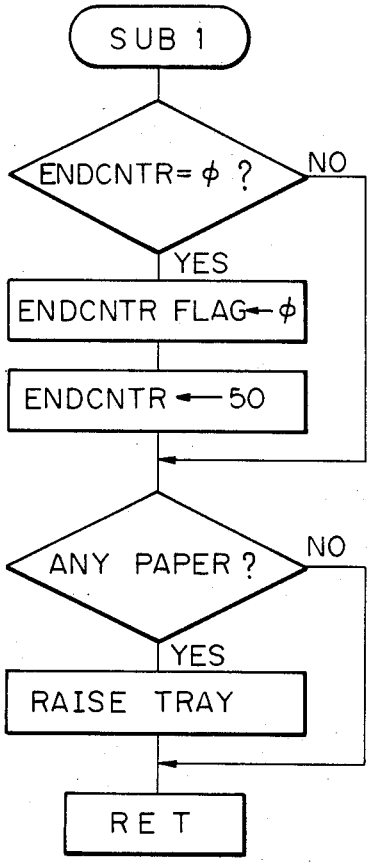
FIGS. 8, 9, 10, 11 and 12 are flowcharts demonstrating a paper feed control procedure in accordance with a first embodiment of the present invention.

Referring to FIG. 8, SUB 1 is representative of a subroutine which is called up at the time of power turnon and the time of tray setting. ENDCNTR is representative of a variable into which a number of pulses which the encoder generates upon feed of 20 papers is entered. That is, when the number of encoder pulses appearing during upward movement of the tray has increased beyond (1000–ENDCNTR), that the number of remaining papers has decreased beyond 20 is decided to stop the copying operation. At the instant of power turnon, the data memorized last time has been held in the NV-RAM 34 and, therefore, the value is not zero; if papers are present, the tray 14 is raised. However, when the tray 14 has been pulled out of the copier, the ENDCNTR is reset to zero by another subroutine and, as an immediate measure, a value "50" is entered. An ENDCNTR flag is adapted to indicate whether the value of the ENDCNTR has become definite after actually counting encoder pulses; if it is a ZERO, the value has not become definite yet.

Figure 9:
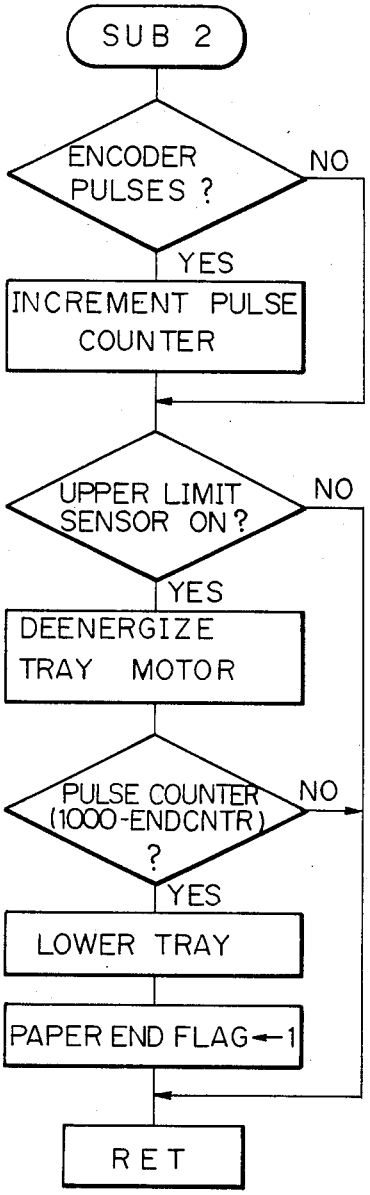
Figure 10:
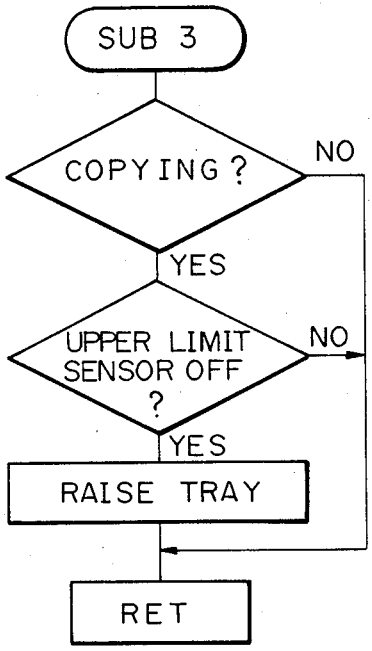

The tray 14 which has begun to rise after the SUB 1 is brought to a halt at the upper limit by SUB 2, which is shown in FIG. 9. However, if the number of encoder pulses counted then is greater than (1000−ENDCNTR), the tray 14 is lowered to wait for the supply of papers. The SUB 2 is representative of a subroutine which is constantly called up at short intervals during copying cycles as well. It is SUB 3 shown in FIG. 10 that maintains the tray 14 at the paper feed level. When called up, the SUB 3 determines whether a copying operation is under way and, if the result is "YES", delivers a raise signal to rotate the motor 12 when the upper limit sensor is off.

Figure 11:
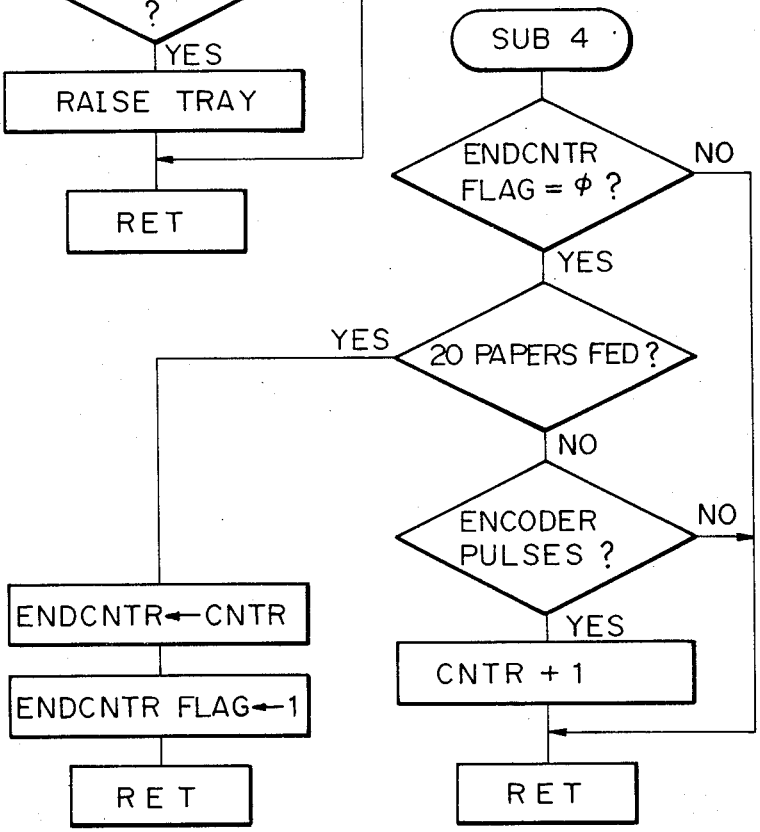

After paper feed has been actually started, how many encoder pulses appear for the feed of twenty papers is known. Hence, if the ENDCNTR is not definite yet, i.e., if ENDCNTR flag is a ZERO, it is necessary to enter the pulses generated into the ENDCNTR. A flowchart demonstrating such an operation is represented by SUB 4 in FIG. 11. Because the ENDCNTR flag is a ZERO and the ENDCNTR is not definite yet, the number of encoder pulses which appear for twenty papers is entered into CNTR. After the feed of twenty papers, the value of the CNTR is entered into the ENDCNTR. Assuming that forty pulses have appeared during the feed of twenty papers, the ENDCNTR reaches a count "40". At the same time, the ENDCNTR flag becomes a ONE to show that the ENDCNTR has become definite. Thereafter, the pulse counter is sequentially incremented as the paper feed proceeds. When the number of pulse counters has exceeded "960", i.e., when the number of remaining papers has decreased to "20", a paper end flag is made a ONE to stop the copying operation.

Figure 12:
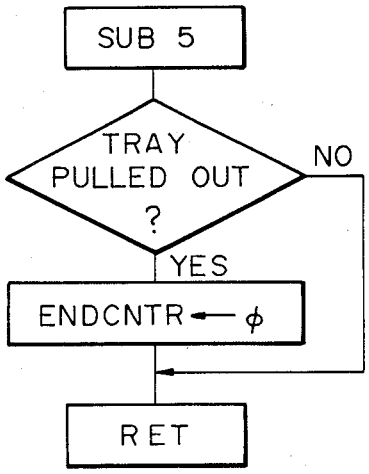

If the value of the ENDCNTR becomes definite through the above-described procedure, a paper-end condition will always be reached when the number of remaining papers is twenty with no regard to the kind of papers. Even if the power source is turned off, the data does not disappear and may be immediately used at the subsequent power turnon because the area of the ENDCNTR is reserved in the NV-RAM 34. However, once the tray 14 is pulled out of the copier, the papers in the tray 14 may possibly be replaced with another stack of papers and, therefore, the ENDCNTR value cannot be trusted. In accordance with this particular embodiment, once the tray 5 is pulled out, ENDCNTR is reset to zero as represented by SUB 5 in FIG. 12 and, then, the ENDCNTR is set again by the SUB 4.

As descrtibed above, this particular embodiment is capable of accurately sensing a near-paper-end condition with no regard to paper thickness and, therefore, allowing papers to be supplied at an adequate timing.

Next, assume a case wherein a particular mode which consumes a great number of papers is selected by an operator.

For example, when one desires to reproduce ten copies of fifty pages of documents, 500 papers in total are required. In this instance, if the number of papers stacked on a tray is smaller than 500, then the copying operation will be stopped midway. This problematic situation may be settled if how many papers are currently left on the tray is known. However, the previously discussed prior art method which sees a particular level of the tray by counting encoder pulses during movement of the tray from the lower limit to the upper limit cannot see the number of papers. Assume that 1000 encoder pulses in total appear during movement of the tray which empty from the lower limit to the upper limit, and that when the tray loaded with papers has been raised, 600 pulses are counted before the tray is brought to a halt at the upper limit. In this instance, the number of remaining papers may be 500 in the case of relatively thin papers such as second originals but may be 300 in the case of relatively thick papers, as previously stated.

In accordance with a second embodiment of the present invention which will be described, the number of papers actually fed and the number of encoder pulses generated then are held in correspondence with each other in order to estimate, for a particular kind of papers currently stacked on a tray, how many papers are left. Then, whether the number of remaining papers is large enough for the specified mode to be completed is decided. If the papers are short, a message or the like is displayed to urge the operator to supply papers.

Such a control will be described with reference to flowcharts.

Figure 13:
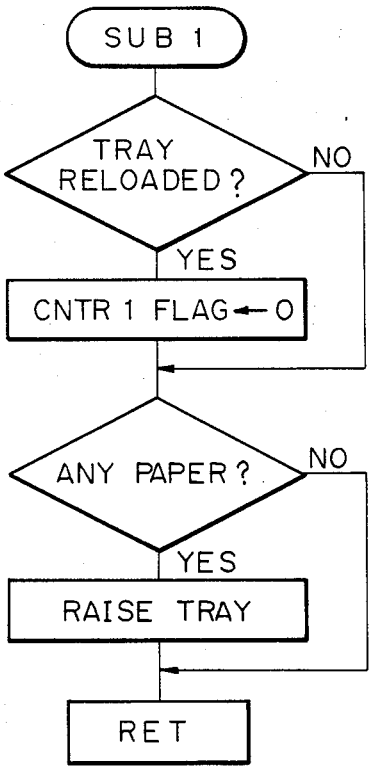
FIGS. 13, 14, 15, 16 and 17 are flowcharts demonstrating a paper feed control procedure in accordance with a second embodiment of the present invention.
Figure 14:
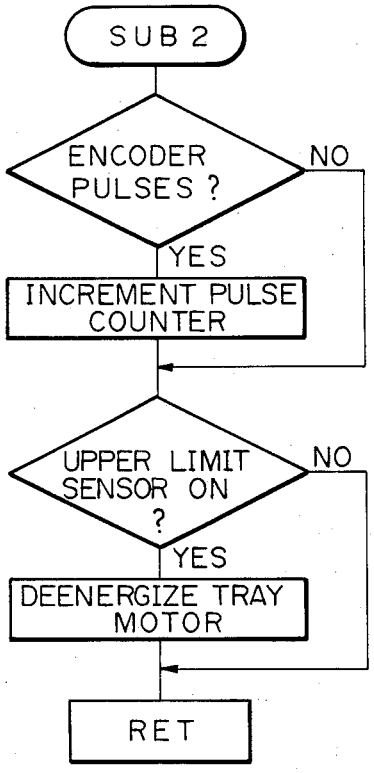

Referring to FIG. 13, SUB 1 is representative of a subroutine which is to be called up at the time of power turnon and the time of tray setting. CNTR 1 is representative of a counter into which the number of pulses generated by an encoder upon the feed of twenty papers is entered. The memory area of the CNTR 1 is reserved in the NV-RAM 34 so that upon power turnon the previous data is entered into the CNTR 1. When the tray 14 is dismounted and then mounted again, papers may possibly have been replaced with another stack. Therefore, in such a condition, the CNTR flag is reset to a ONE so that the value of CNTR 1 may be set anew. A CNTR 1 flag is indicative of whether the CNTR 1 value has become definite in correspondence with the papers presently stacked on the tray; if it is a ONE, the CNR 1 value is definite.

Figure 15:
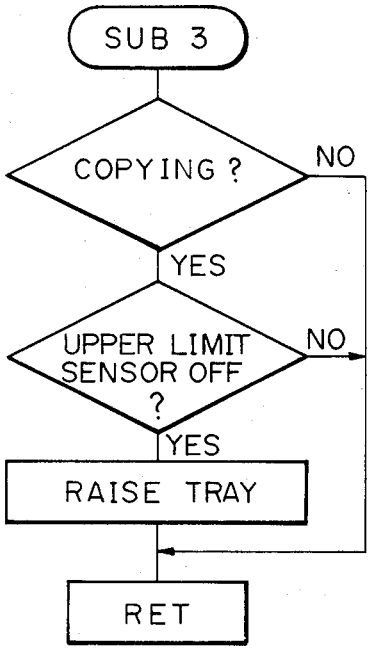
Figure 16:
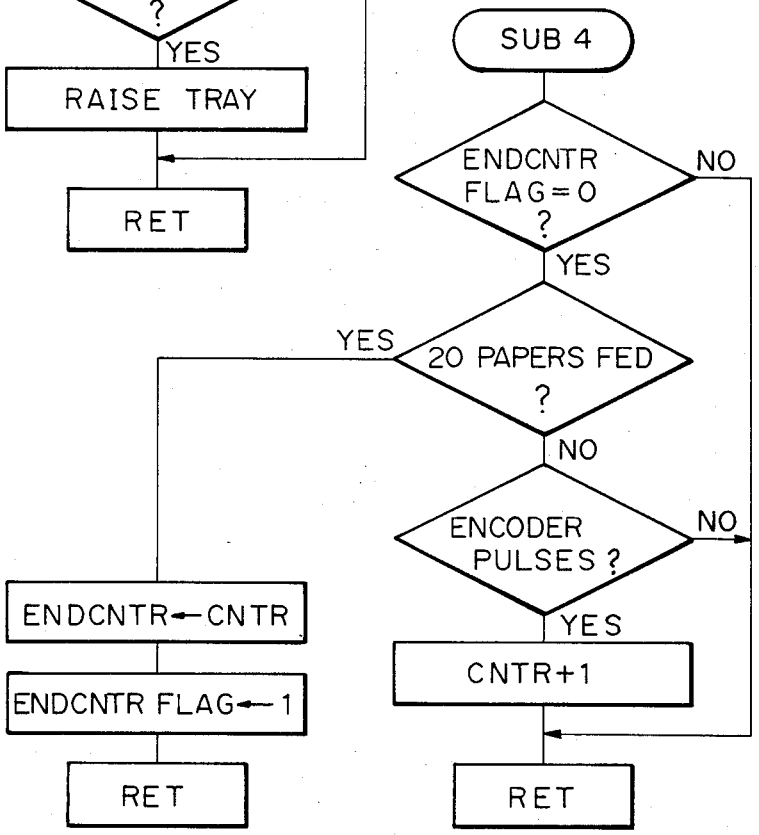

The tray which has begun rising at the SUB 1 is brought to a stop at the upper limit by SUB 2. While the tray moves upward, encoder pulses are continuously counted and the count is entered into the pulse counter. The tray level during copying operation is controlled to a predetermined one by SUB 3 which is shown in FIG. 15. When called up, the SUB 3 decides whether a copying operation is under way and, if the result is "YES", delivers a raise signal to drive the motor 12 when the upper sensor is off. Once paper feed is started, how many encoder pulses are generated for the feed of twenty papers, a unit number, is known. This number of pulses is loaded in the CNTR 1 as a reference for determining the remaining number of papers. Since the CNTR 1 value once determined do not have to be measured thereafter, the CNTR 1 flag is turned to a ONE to indicate that the CNTR 1 value has become definite. A flowchart representative of the operation for determining the CNTR 1 value is represented by SUB 4 in FIG. 16. If the CNTR 1 flag is a ZERO, indicating that the CNTR 1 value is not definite yet, the number of encoder pulses which appear during the feed of twenty papers is entered into CNTR 2. After the feed of twenty papers, the CNTR 2 value is entered into the CNTR 1. For example, if forty pulses have appeared during the feed of twenty papers, the NCTR becomes "40". Simultaneously, the CNTR 1 flag becomes a ONE to show that the CNTR 1 has become definite.

Figure 17:
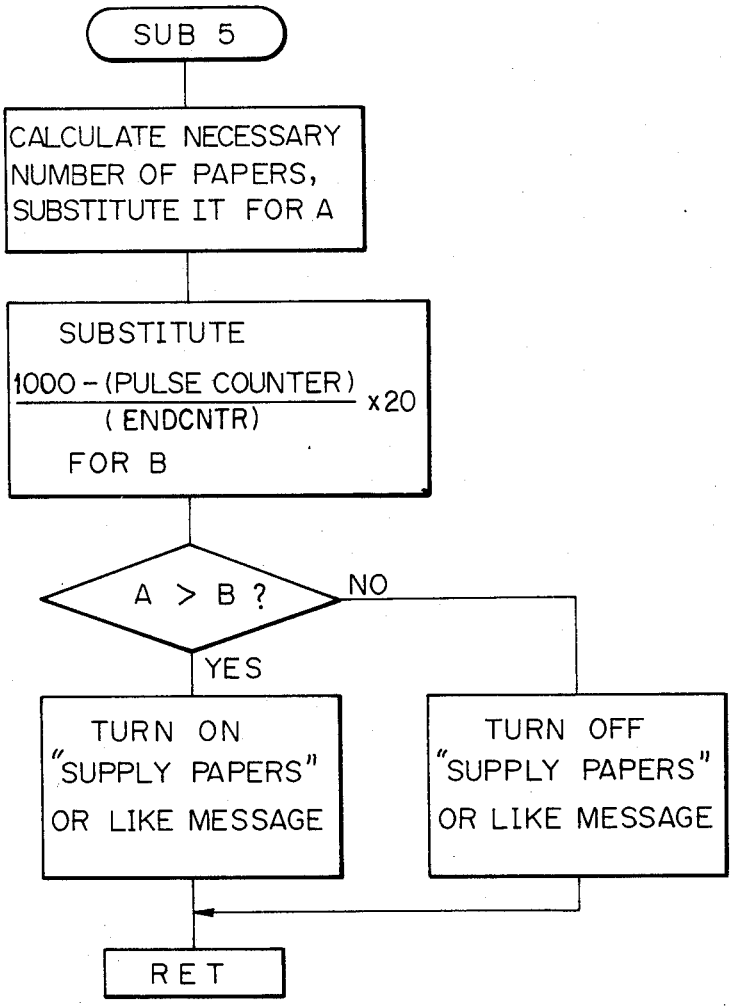

Subsequently, the number of remaining papers in the tray is calculated using the current value of the pulse counter and the CNTR 1 value to see if it is sufficient for the specified copy mode to be fulfilled. If the papers are short, a message or the like is displayed to urge the operator to supply papers. This procedure is represented by SUB 5 in FIG. 17. As shown in FIG. 17, the procedure begins with substituting the necessary number of papers for A. It will be noted that how many papers are necessary in total cannot be known in an ADF mode. In an RDF mode, documents are once circulated through the RDF to be counted so that it is possible to obtain the value of A, i.e. (number of documents)×(specified number of copies). Further, in the case of 1:N, meaning that N copy sheets are to be produced from a single document, N which is specified by the operator is directly used as A.

Thereafter, the number of papers remaining in the tray is calculated and set in B. The pulse counter subtracts the current value from the number of encoder pulses which appeared during the movement of the tray from the lower limit to the upper limit, thereby producing a particular number of encoder pulses which is associated with a height of the stack of remaining papers. Dividing that number by the previously mentioned CNTR 1 value provides the remaining number of papers, this number being substituted for B. If A is greater than B, a message or the like is displayed to urge the operator to supply papers. What is required here is, because the value of B produced possibly involves some error, estimating B somewhat small during comparison between A and B.

As described above, in accordance with this particular embodiment, an operator can be accurately informed of shortage of papers with no regard to the kind of papers.

Various modifications will become possible for those skilled in the art after receiving the teachings of the present disclosure without departing from the scope thereof.

What is claimed is:

1. A paper feed control device for controlling the paper to be at a predetermined height by moving a tray holding the paper up and down, comprising:

encoder means for generating pulses responsive to a particular amount of movement of the tray in the up direction;

first counter means for counting a predetermined number of papers fed from the tray;

second counter means for counting a number of pulses generated by the encoder means during the time that the predetermined number of sheets are being counted by the first counter means;

a first calculating means for determining the number of papers needed;

second calculating means for determining how many sheets remain in the tray by subtracting a total number of pulses generated by the encoder means during the movement of the tray from a total number of pulses which would be generated if the tray were empty, the difference being divided by the number of pulses counted in the second counter;

a comparison means for comparing the number of papers needed as determined by the first calculating means with the number of papers remaining as determined by the second calculating means;

first storage means for storing the results of said first and second counter means and said first and second calculating means; and second storage means for storing instructions for said control device;

said first storage means being a non-volatile RAM; and means for clearing the stored result of said second counter means in said first storage means in response to a detection that said tray is being loaded with said paper.

* * * * *